US009293240B2

(12) United States Patent
Kroulik

(10) Patent No.: US 9,293,240 B2
(45) Date of Patent: Mar. 22, 2016

(54) LOW INDUCTANCE ELECTRICAL TRANSMISSION CABLE

(71) Applicant: FLEX-CABLE, Howard City, MI (US)

(72) Inventor: Erwin Kroulik, Edmore, MI (US)

(73) Assignee: FLEX-CABLE, Howard City, MI (US)

( * ) Notice: Subject to any disclaimer, the term of this patent is extended or adjusted under 35 U.S.C. 154(b) by 0 days.

(21) Appl. No.: 14/026,889

(22) Filed: Sep. 13, 2013

(65) Prior Publication Data

US 2014/0069718 A1 Mar. 13, 2014

Related U.S. Application Data

(60) Provisional application No. 61/700,872, filed on Sep. 13, 2012.

(51) Int. Cl.

| | |
|---|---|
| ***H01B 7/30*** | (2006.01) |
| ***H01B 13/06*** | (2006.01) |
| *H01R 9/11* | (2006.01) |
| *H01B 9/00* | (2006.01) |

(52) U.S. Cl.

CPC ..... *H01B 7/306* (2013.01); *H01B 13/06* (2013.01); *H01B 9/006* (2013.01); *H01R 9/11* (2013.01); *Y10T 29/49174* (2015.01)

(58) Field of Classification Search

CPC ..... H01B 11/00; H01B 7/00

See application file for complete search history.

(56) References Cited

U.S. PATENT DOCUMENTS

| | | | | |
|---|---|---|---|---|
| 371,162 | A | | 10/1887 | Algeo |
| 380,566 | A | | 4/1888 | Hampton |
| 417,092 | A | | 12/1889 | Rembert |
| 477,824 | A | | 6/1892 | Robinson |
| 547,518 | A | | 10/1895 | Hunter |
| 576,383 | A | | 2/1897 | Sterling |
| 590,163 | A | | 9/1897 | Pearson |
| 596,929 | A | | 1/1898 | Wilson |
| 4,208,542 | A | * | 6/1980 | Endo ..... H01B 7/0009 174/113 C |
| 4,675,475 | A | * | 6/1987 | Bortner et al. ..... 174/113 R |
| 5,266,744 | A | * | 11/1993 | Fitzmaurice ..... 174/36 |
| 5,317,804 | A | * | 6/1994 | Kasper ..... 29/860 |
| 5,376,758 | A | * | 12/1994 | Kimber ..... H01B 11/12 174/113 C |
| 6,246,001 | B1 | | 6/2001 | Fukui |
| 6,247,221 | B1 | | 6/2001 | Ritland et al. |
| 6,686,537 | B1 | * | 2/2004 | Gareis et al. ..... 174/36 |
| 6,943,312 | B2 | | 9/2005 | Zimmermann |
| 7,703,371 | B2 | | 4/2010 | Morissette et al. |
| 2004/0192080 | A1 | | 9/2004 | Li |
| 2004/0200635 | A1 | | 10/2004 | Menze et al. |
| 2005/0191906 | A1 | | 9/2005 | Li |
| 2007/0193768 | A1 | | 8/2007 | Howe |

* cited by examiner

*Primary Examiner* — Timothy Thompson
*Assistant Examiner* — Krystal Robinson
(74) *Attorney, Agent, or Firm* — Blue Filament Law PLLC; Avery N. Goldstein

(57) ABSTRACT

An electrical transmission cable is provided with low inductance properties capable of carrying high current loads with a more uniform heating or loss profile. The low inductance properties of the cable lead to lower current losses resulting in a cooler and more efficient operation of the cable even at higher alternating current (AC) frequencies. Higher current loads are accommodated by a plurality of conductor bundles configured as braided wire strands that are separated and joined into like conductors prior to termination. Equal lengths of the insulated wire strands within the conductor bundles contribute to uniform heating along the length of the inventive cable embodiments. Uniform operating temperature is manifest as more uniform current transmission across the various strands of an inventive cable. In addition, the more equal weave position for all the wire strands making up each braided wire bundle tends to induce cancellation of inductive effects.

8 Claims, 4 Drawing Sheets

LOW INDUCTANCE ELECTRICAL TRANSMISSION CABLE

CROSS-REFERENCE TO RELATED APPLICATION

This application claims priority of U.S. Provisional Patent Application Ser. No. 61/700,872 filed Sep. 13, 2012, which is incorporated herein by reference.

FIELD OF THE INVENTION

The present invention in general relates to electrical cables and in particular to electrical transmission with low inductance properties.

BACKGROUND OF THE INVENTION

Skin effect is the tendency of an alternating electric current (AC) to become distributed within a conductor such that the current density is largest near the surface of the conductor, and decreases with greater depths in the conductor. The electric current flows mainly at the "skin" of the conductor, between the outer surface and a level called the skin depth (δ) as shown in prior art FIG. 1. The skin effect causes the effective resistance of the conductor to increase at higher frequencies where the skin depth is smaller, thus reducing the effective cross-section of the conductor. For alternating current, nearly two thirds of the electrical current flows between the conductor surface and the skin depth, δ. The skin effect is due to opposing eddy currents ($I_w$) induced by the changing magnetic field (H) resulting from the alternating current (I) as shown in prior art FIG. 2. For example, at 60 Hz in copper, the skin depth is about 8.5 mm. At high frequencies the skin depth becomes much smaller and increases AC resistance.

A proximity effect occurs in an AC carrying conductor, where currents are flowing through one or more other nearby conductors, such as within a closely wound coil of wire, and the distribution of current within the first conductor is constrained to smaller regions. The resulting current crowding is termed the proximity effect. The proximity effect increases the effective resistance of a circuit, which increases with frequency. As was explained above for the skin effect for AC flow, the changing magnetic field will influence the distribution of an electric current flowing within an electrical conductor, by electromagnetic induction. When an alternating current (AC) flows through an isolated conductor, the alternating current creates an associated alternating magnetic field around it. The alternating magnetic field induces eddy currents in adjacent conductors, altering the overall distribution of current flowing through them. The result is that the current is concentrated in the areas of the conductor furthest away from nearby conductors carrying current in the same direction. Similarly, in two adjacent conductors carrying alternating currents flowing in opposite directions, such as are found in power cables and pairs of bus bars, the current in each conductor is concentrated into a strip on the side facing the other conductor In order to address transmission loses and inductance associated with transmission associated with the skin effect, the prior art has often resorted to numerous thin conductors that form a bundle as shown in FIG. 3. This has not been wholly successful in that electromagnetic effects are non-uniform across the bundle cross-section thereby creating other types of transmission loses.

FIG. 4 illustrates a prior art, existing cable design 10 formed of several insulated conductor wires (14, 16) in an interwoven pattern 12 and grouped into like bundles of conductors (14*b*, 16*b*) at the cable input and output terminations 18. While this design offers an improved operating performance, non-uniform heating still results during operation due to variations in conductor wire lengths in the weave pattern.

While there have been many advances in electrical transmission cable design, there still exists a need for electrical transmission cables with low inductance properties capable of carrying high current loads with a more uniform heating or loss profile.

SUMMARY OF THE INVENTION

An electrical transmission cable is provided with low inductance properties capable of carrying high current loads with a more uniform heating or loss profile. The low inductance properties of embodiments of the inventive cable lead to lower current losses resulting in a cooler and more efficient operation of the inventive cable even at higher alternating current (AC) frequencies. Higher current loads are accommodated by a plurality of conductor bundles configured as braided wire strands that are separated and joined into like conductors prior to termination. Equal lengths of the insulated wire strands within the conductor bundles contribute to uniform heating along the length of the inventive cable embodiments. Uniform operating temperature is manifest as more uniform current transmission across the various strands of an inventive cable. In addition, the more equal weave position for all the wire strands making up each braided wire bundle tends to induce cancellation of inductive effects. It has also been surprisingly observed that external electromagnetic field (EMF) perturbations are at least partly occluded to an inventive electrical transmission cable thereby reducing or eliminating the need for magnetic shielding of transmission cables with materials such as mu-metal. Non-limiting applications for embodiments of the inventive cable with low inductance characteristics include high frequency transformers for welders, inductive heaters, servo-motor power supply, magnetic resonance instrument power supply, and avionics.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention

DESCRIPTION OF THE INVENTION

The present invention has utility as a low inductance electrical transmission cable. The low inductance properties of embodiments of the inventive cable lead to lower current losses resulting in a cooler and more efficient operation of the inventive cable even at higher alternating current (AC) frequencies. Higher current loads are accommodated by a plurality of conductor bundles configured as braided wire strands that are separated and joined into like conductors prior to termination. Equal lengths of the insulated wire strands within the conductor bundles contribute to uniform heating along the length of the inventive cable embodiments. Uniform operating temperature is manifest as more uniform current transmission across the various strands of an inventive cable. In addition, the more equal weave position for all the wire strands making up each braided wire bundle tends to induce cancellation of inductive effects. It has also been surprisingly observed that external electromagnetic field (EMF) perturbations are at least partly occluded to an inventive electrical transmission cable thereby reducing or eliminating the need for magnetic shielding of transmission cables with materials such as mu-metal. Non-limiting applications for embodiments of the inventive cable with low inductance characteristics include high frequency transformers for welders, inductive heaters, servo-motor power supply, magnetic resonance instrument power supply, and avionics.

Figure 1:
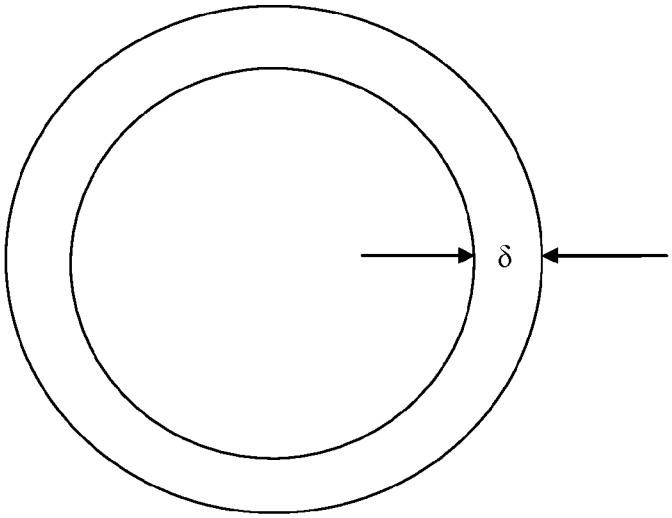
FIG. 1 (Prior Art)
FIG. 1 is a prior art cross sectioned view of a conductor illustrating the skin depth (δ) of alternating current (AC) flow.
Figure 2:
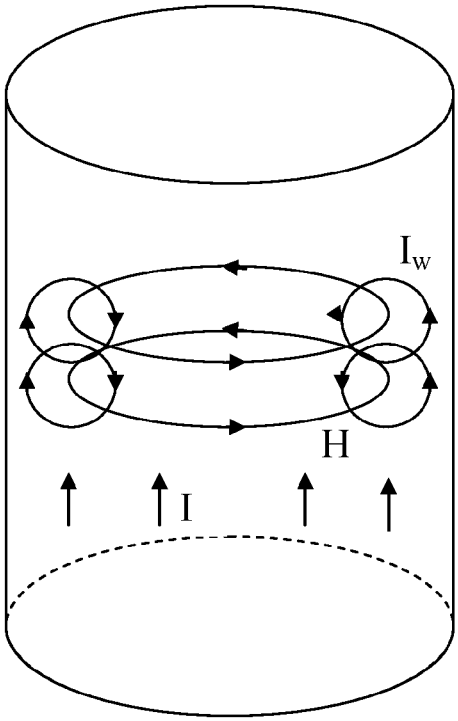
FIG. 2 (Prior Art)
FIG. 2 is a prior art line drawing illustrating the formation of the skin effect by opposing eddy currents (Iw) induced by the changing magnetic field (H) resulting from an alternating current (I)
Figure 3:
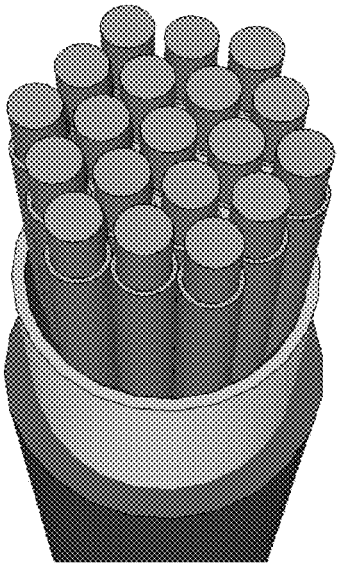
FIG. 3 (Prior Art)
FIG. 3 is a prior art perspective view of a conventional cable.
Figure 4:
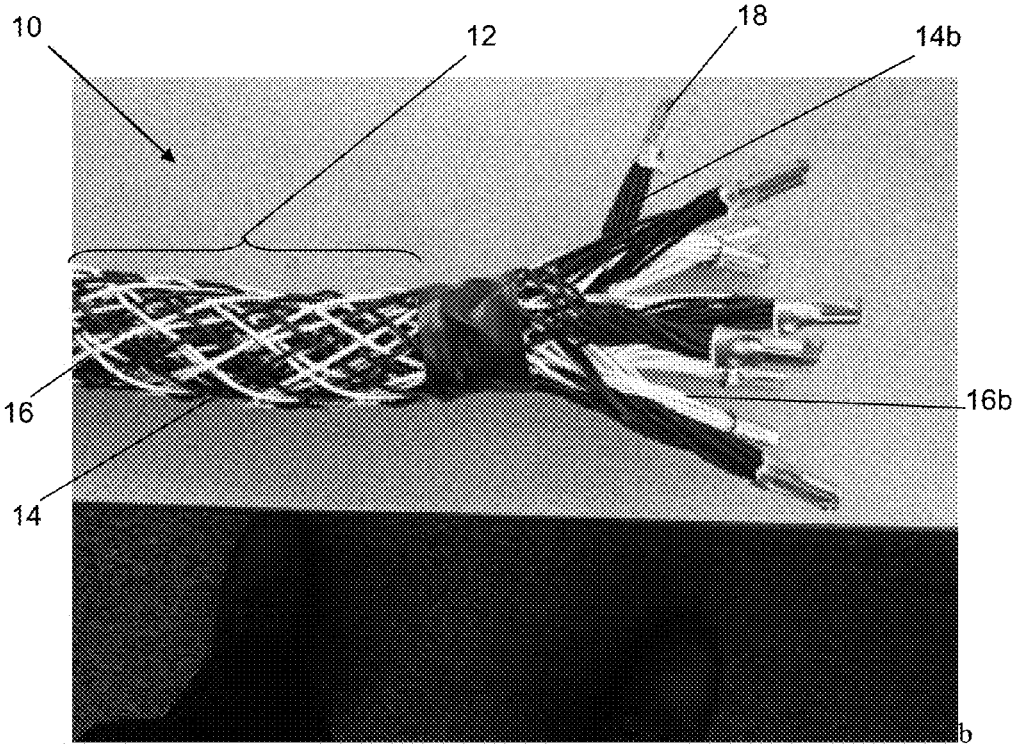
FIG. 4 (Prior Art)
FIG. 4 is a prior art existing cable design formed of insulated wires in an interwoven pattern and grouped into like bundles at the cable input and output terminations.
Figure 5:
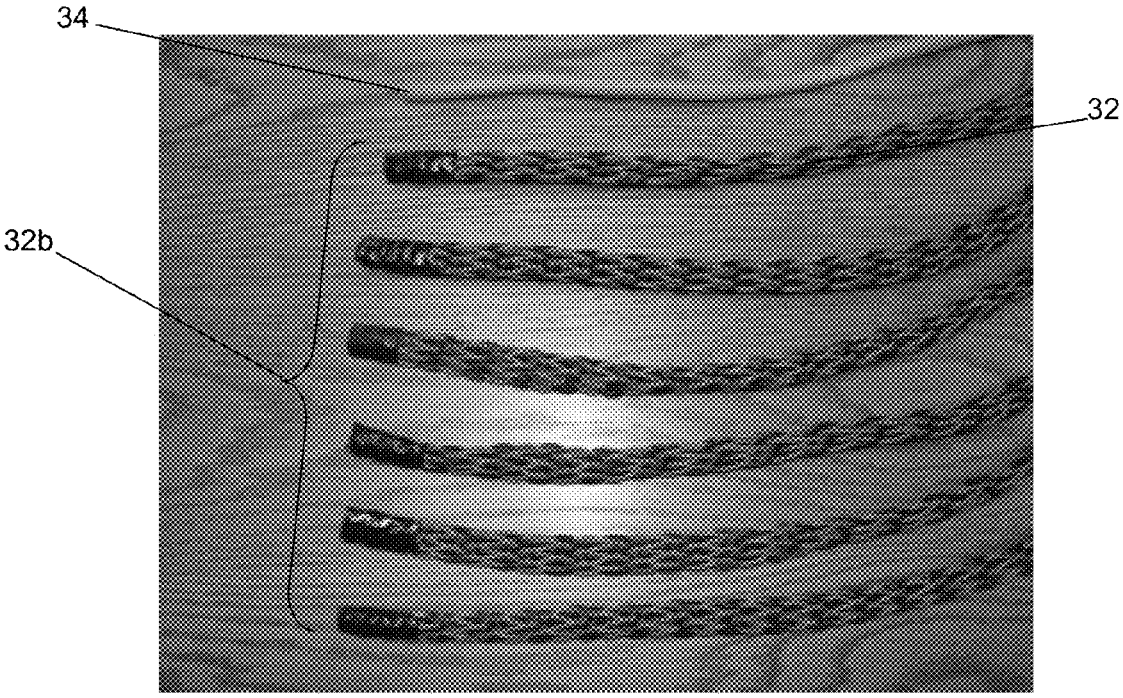
FIG. 5 illustrates a set of bundles of braided strands of insulated wires and a ground wire used to form a low inductance electrical transmission cable according to embodiments of the invention.
Figure 6:
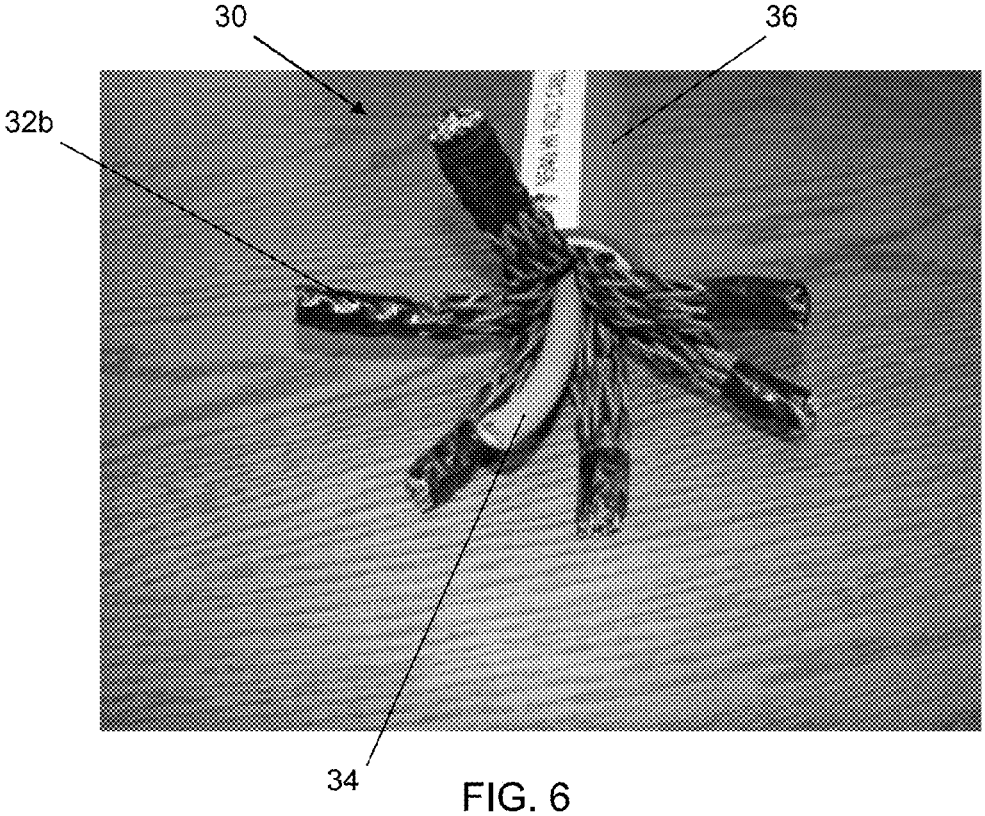
FIG. 6 illustrates the set of bundles of braided strands of insulated conductive wires and the ground wire of FIG. 5 inside an insulating jacket, prior to separation of the conductive wires into like conductors with terminations to form a low inductance electrical transmission cable according to embodiments of the invention.
Figure 7:
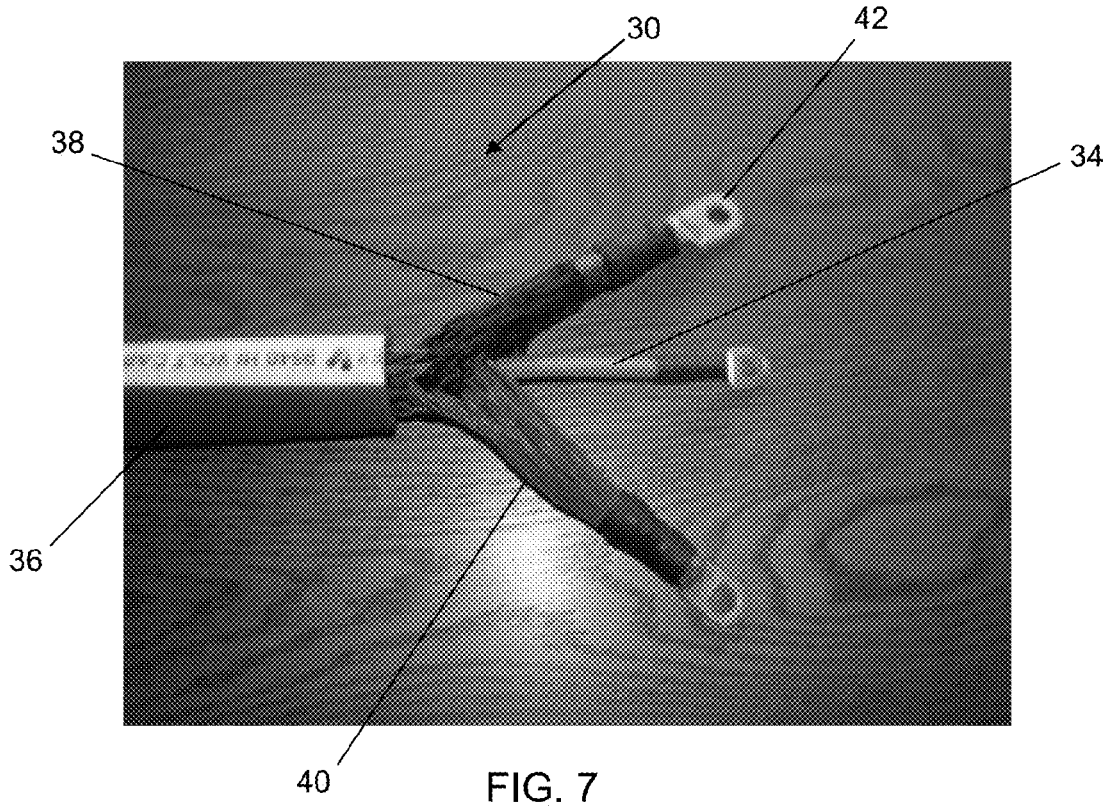
FIG. 7 illustrates the set of bundles of braided strands of insulated conductive wires and the ground wire of FIG. 5 inside an insulating jacket, with separation of the conductive wires into like conductors with terminations applied to form a low inductance electrical transmission cable according to embodiments of the invention.

FIGS. 5-7 illustrate an embodiment of a high frequency high voltage cable 30 with low inductance properties. FIG. 5 illustrates the conductive components of the cable 30 with a set of bundles 32*b* of braided strands of insulated wires 32 and a ground wire 34 used to form a high frequency high voltage cable 30 with low inductance properties according to embodiments of the invention. The individual strands 32 for example have red and black sheaths (or other color combinations) to form pairs of insulated wires with the thickness of the bundle dependent on the strand diameter and number of wire strand 32 pairs used to make up the bundle 32*b*. Wire lengths of the individual strands 32 are substantially equal as is the length of each bundle 32*b* in certain inventive embodiments. As used herein, substantial equality as to length is defined as an absolute deviation of less than ±5 length percent, and in other instances between ±0.1 and 1 length percent, and in still other instances between ±0.01 and 0.5 length percent. In a particular embodiment, a first polarity voltage is applied to a first color code set of bundles 32*b* (e.g. red), while an opposite polarity voltage is applied to the second color coded set of bundles 32*b* (e.g. black). The weave pattern of the strands 32 ensures an even heating distribution along the length of the bundle 32*b*. It is noted that electrical tape is shown on the ends of the bundles 32*b* in FIGS. 5 and 6 prior to placement of terminations 42 in FIG. 7. In FIG. 6 the individual bundles 32*b* are positioned around a ground wire 34 core within an outer insulator jacket 36 of textile yarn, tape, extruded compounds, or other suitable protective materials. FIG. 7 illustrates the set of bundles 32*b* of braided strands of insulated conductive wires 32 and the ground wire 34 inside the insulating jacket 36, with separation of the conductive wires 32 into like conductor bundles (38—black, 40—red) with terminations 42 applied to form a high voltage high frequency cable 30 with low inductance properties according to embodiments of the invention. In specific embodiments, the conditions of the various wires are formed of copper, copper containing alloys, superconductors, nickel, nickel alloys, or a combination thereof.

Figure 8:
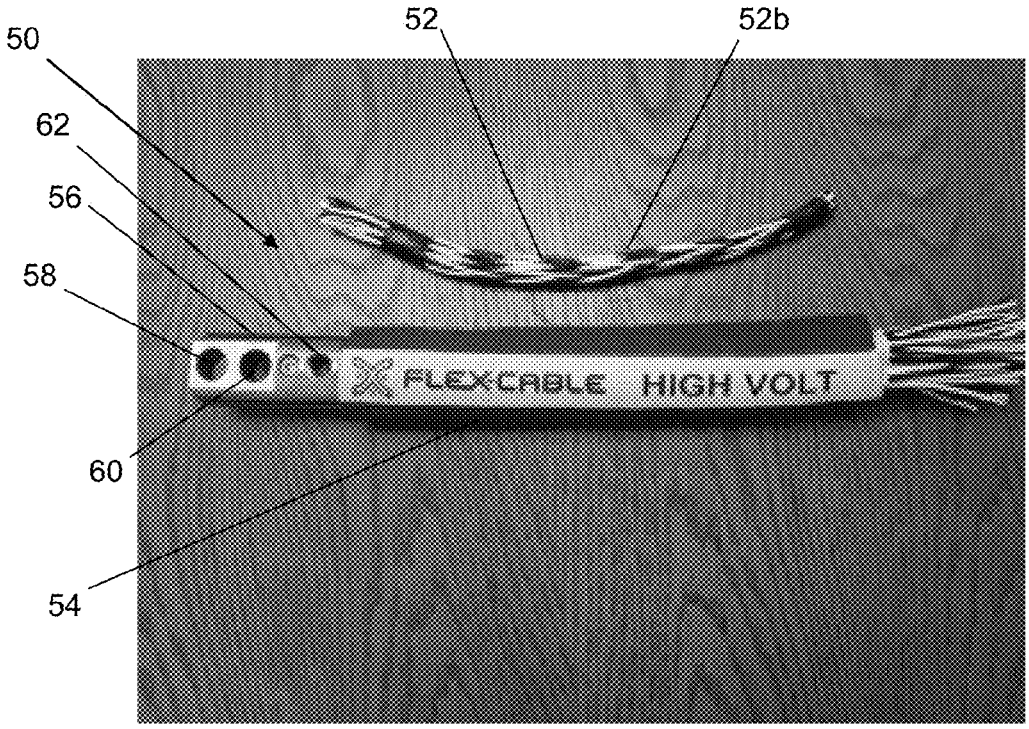
FIG. 8 illustrates a low inductance electrical transmission cable from bundles of braided strands of insulated conductive wires inside an insulating jacket, with an air or water cooled connector according to an embodiment of the invention.

FIG. 8 illustrates an inventive electrical transmission cable 50 with low inductance properties formed from bundles 52*b* of braided strands of insulated conductive wires 52 inside an insulating jacket 54, with an air or water cooled connector 56 according to an embodiment of the invention. The individual strands 52 for example have white and black sheaths (or other color combinations) to form pairs of insulated wires with the thickness of the bundle 52*b* dependent on the strand diameter and number of wire strand 52 pairs used to make up the bundle 52*b*. Wire lengths of the individual strands 52 are substantially equal as is the length of each bundle 52*b*. In a particular embodiment, a first polarity voltage is applied to a first color code set of bundles 32*b* (e.g. white), while an opposite polarity voltage is applied to the second color coded set of bundles 32*b* (e.g. black). The weave pattern of the strands 52 ensures an even heating distribution along the length of the bundle 52*b*. Prior to termination of the cable 50 the individual strands 52 are separated into like colors (color coded strand sets) from each of the bundles 52*b* for securement to connector 56. Connector 56 has two connection points 58 and 60 in exclusive electrical contact or communication with one of the two color coded strand sets. In an embodiment, opening 62 may be used to supply fluids or air for cooling the cable 50.

The foregoing description is illustrative of particular embodiments of the invention, but is not meant to be a limitation upon the practice thereof. The following claims, including all equivalents thereof, are intended to define the scope of the invention.

The invention claimed is:

1. A cable assembly comprising:

a plurality of bundles, each one of said plurality of bundles with a first end and a second end where said first end corresponds to a proximal end of said cable assembly and said second end corresponds to a distal end of said cable assembly that houses said plurality of bundles, each bundle of said plurality of bundles including sets of strands of equal lengths, each individual set of said sets of strands being formed of a pair of sheathed insulated wires, where a first sheathed insulated wire from the pair is coded to carry a first polarity voltage and a second sheathed insulated wire from the pair is coded to carry a second polarity voltage, and where said first sheathed insulated wires and said second sheathed insulated wires are braided into a weave pattern of said sets of strands that evenly distributes each of said first sheathed insulated wires and said second sheathed insulated wires on the inner and outer portion of said bundle between said first end and said second end; and wherein said first sheathed insulated wires and said second sheathed insulated wires are separated and segregated into like conductors from the sets of strands from said plurality of bundles, and the like conductors are electrically joined to separate terminations at said proximal end and said distal end of said cable assembly; and an outer insulator jacket for housing said plurality of bundles in said cable assembly.

2. The cable assembly of claim 1 further comprising a ground wire surrounded by said bundles in the interior of said outer insulator jacket.

3. The cable assembly of claim 1 wherein said outer insulator jacket is made of at least one of textile yarn, tape, or extruded compounds.

4. The cable assembly of claim 1 wherein said termination is air or water cooled.

5. A method for forming a cable assembly comprising:

forming a plurality of bundles, each one of said plurality of bundles with a first end and a second end where said first end corresponds to a proximal end of said cable assembly and said second end corresponds to a distal end of said cable assembly that houses said plurality of bundles, each bundle of said plurality of bundles including sets of strands of equal lengths, each individual set of said sets of strands being formed of a pair of sheathed insulated wires, where a first sheathed insulated wire from the pair is coded to carry a first polarity voltage and a second sheathed insulated wire from the pair is coded to carry a second polarity voltage, and where said first sheathed insulated wires and said second sheathed insulated wires are braided into a weave pattern of said sets of strands that evenly distributes each of said first sheathed insulated wires and said second sheathed insulated wires on the inner and outer portion of said bundle between said first end and said second end;

placing an outer insulator jacket on said plurality of bundles;

separating and segregating said first sheathed insulated wires and said second sheathed insulated wires into like conductors from the sets of strands from said plurality of bundles;

grouping said like conductors at said first end and said second end; and joining said groupings to separate terminations at said proximal end and said distal end of said cable assembly.

6. The method of claim 5 further comprising placing a ground wire in the interior of said outer insulator jacket surrounded by said bundles.

7. The method of claim 5 wherein said outer insulator jacket is made of at least one of textile yarn, tape, or extruded compounds.

8. The method of claim 5 wherein said termination is air or water cooled.

* * * * *